US005498183A

United States Patent [19]

Riviera

[11] Patent Number: 5,498,183

[45] Date of Patent: Mar. 12, 1996

[54] SIDEWAYS LOADABLE MARINE SPARE PROPELLER MOUNT

[76] Inventor: Donald J. Riviera, 15248 Englewood, Allen Park, Mich. 48101

[21] Appl. No.: 307,342

[22] Filed: Sep. 16, 1994

[51] Int. Cl.[6] ..... B63B 17/00

[52] U.S. Cl. ..... 440/113; 114/364; 224/406; 416/244 B

[58] Field of Search ..... 114/364; 440/49, 440/113; 416/62, 63, 244 B, 146 R, 146 B; 224/273, 42.12, 42.24, 42.45 R, 406, 567, 570, 545

[56] References Cited

U.S. PATENT DOCUMENTS

| | | | |
|---|---|---|---|
| 4,068,856 | 1/1978 | Harris | 224/42.24 |
| 4,789,303 | 12/1988 | Frazzell et al. | 416/146 R |
| 5,080,269 | 1/1992 | Larsson et al. | 224/42.24 |

*Primary Examiner*—Sherman Basinger

[57] ABSTRACT

A marine spare propeller mounting device used for safely securing a marine spare propeller on board a recreational or work vessel powered by common sterndrive units or large outboard motors. This invention includes a plastic base plate (2) that accepts a stainless steel center axial shaft (3) as well as a stainless steel thrust washer (16) and a retaining knob (4). The stainless steel thrust washer (16) is slipped over the stainless steel center axial shaft (3) and the retaining knob (4) is started on the threaded end of the center axial shaft (18). Then this assembly comprised of the stainless steel center axial shaft (3) and the stainless steel thrust washer (16) and the retaining knob (4) is slid through the propeller hub housing (6) leaving the head of the center axial shaft (13) exposed enough from propeller hub housing (6) to allow the head of the center axial shaft (13) to be inserted into center axial shaft mounting slot entrance (10) while propeller exhaust flange (9) is held above base plate raised retaining ring (7). Then the assembly is slid into its final nesting position with the head of the center axial shaft (13) being against the square end of the center axial shaft mounting slot (15) and the propeller exhaust flange (9) is seated in the base plate raised retaining ring (7). Then the retaining knob (4) may be tightened against stainless steel thrust washer (16) and propeller hub housing (6) thus retaining marine propeller (1). This invention will hold the above stated spare marine propeller safely in its assigned storage location on board a marine vessel.

1 Claim, 3 Drawing Sheets

SIDEWAYS LOADABLE MARINE SPARE PROPELLER MOUNT

CROSS REFERENCES TO RELATED APPLICATIONS

1. Background—Field of Invention

This invention relates to a marine spare propeller holding device. More particularly, it refers to a sideways loadable holding device for marine spare propellers used on vessels powered by sterndrive units or large outboard motors.

2. Description—Prior Art

Marine propellers used on vessels powered by sterndrive units or large outboard motors can be cumbersome items to store onboard a moving marine vessel. This invention provides a safe and secure means to store such a propeller onboard such a vessel. Unfortunately, except for expensive mounting devices available for high performance marine applications, such mounting devices are not regularly used. Although prior art reveals different ways to secure an object with a through hole, without significant change these devices are not suitable for use when storing marine propellers onboard a moving marine vessel. As in the case of U.S. Pat. No. 4,068,856 which comprises a screw part, a nut part and an attachment part to secure the screw part to a surface, the attachment part will not snugly nest a propeller to inhibit movement on the surface, also it does not provide protection for the surface to which the object is mounted. Clamping a marine propeller made from metal to a surface made of wood or fiberglass would cause damage to the mounting surface, this would be unacceptable to most pleasure boat owners.

Another type of fixation device that can be used to mount an object with a through hole to a surface is U.S. Pat. No. 5,080,269. This device also comprises a screw part, a nut part and an attachment part to secure the screw part to a surface. The attachment part would require the addition of screw clearance holes for mounting, since spot welding or gluing would not be acceptable in most marine vessels. The attachment part would only center and restrain the object from movement on the surface to which it was mounted by having the raised area of the attachment part nest in an internal surface of the object. In the case of a marine propeller, this nesting surface is the inside diameter of the outer hub to which the blades are affixed. This area is much larger in diameter than the through hole of the inner hub which mates with the propeller drive shaft. Therefore the flanges on the screw part would be larger in diameter than the hole through which they must pass. If the screw part flanges are small enough in diameter to pass through the propeller spline shaft opening, the raised area of the attachment part would fail to center and nest the propeller. The screw part may enter the attachment part in one of two positions of rotation of the screw part. The screw part could be difficult to align with the attachment part if a poorly lighted or cramped out of the way spot were chosen to mount a spare propeller.

The object of the present invention is to eliminate the above-mentioned problems and to encourage the public to use spare propeller mounting devices to safely secure spare propellers onboard marine vessels powered by sterndrive units or large outboard motors. Therefore, a simple and inexpensive spare propeller securing device is needed.

OBJECTS AND ADVANTAGES

Accordingly, several objects and advantages of my invention are to provide a spare propeller securing device to safely hold a marine propeller used with sterndrive units or large outboards which obviates the disadvantages of other similar devices, specifically which is inexpensive, compact in size, can be loaded with a sideways motion and which for safety reasons has a center axial shaft being removable when a propeller is not being stored in the device.

Still further objects and advantages will become apparent from a consideration of the ensuing description and accompanying drawings.

REFERENCE NUMERALS

Figure 1:
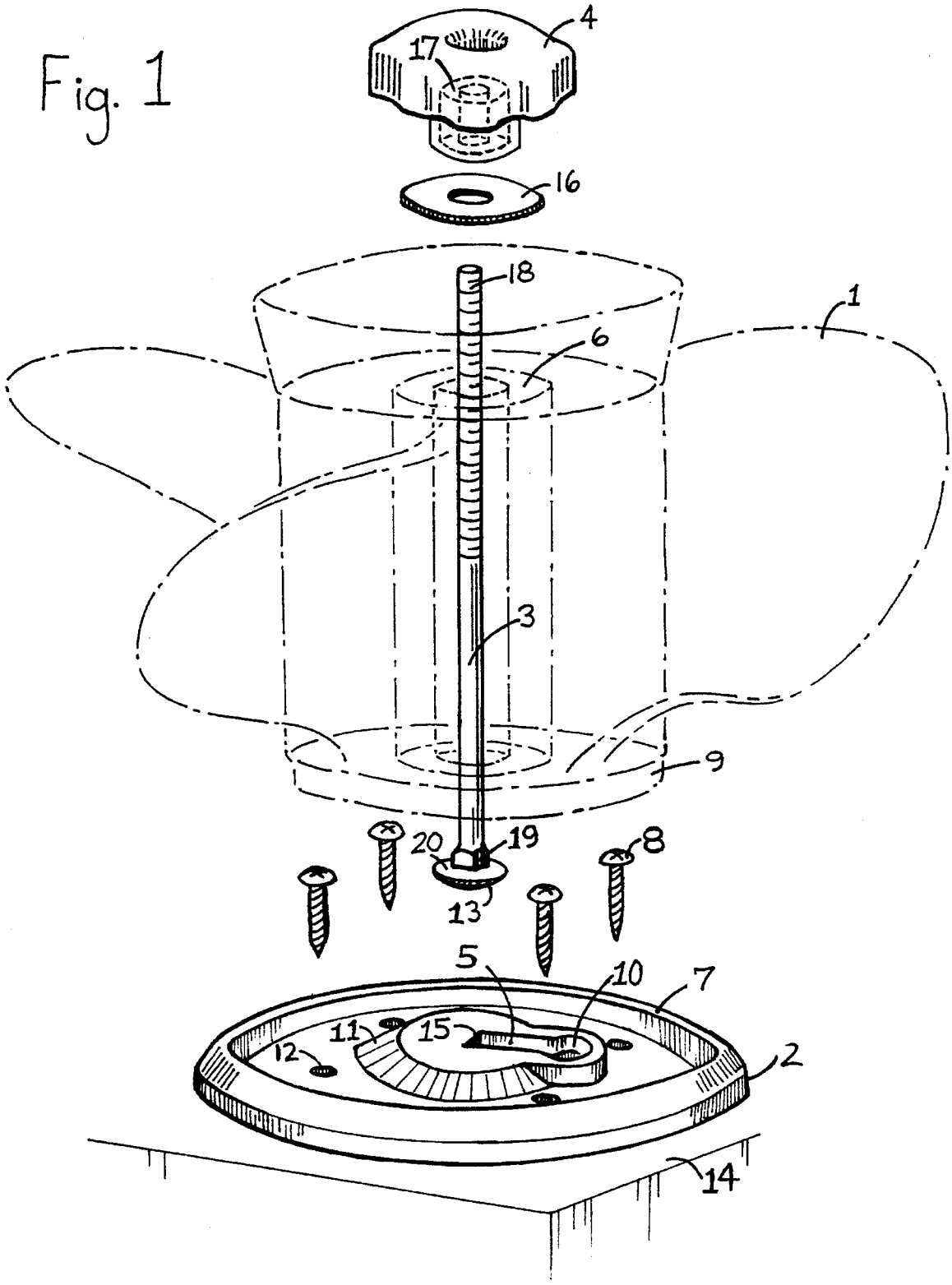
FIG. 1 shows an exploded view of the marine propeller and the mount in accordance with the invention.

1 marine propeller
2 plastic base plate
3 stainless steel center axial shaft
4 retaining knob
5 center axial shaft mounting slot
6 propeller hub housing
7 base plate raised retaining ring
8 stainless steel mounting screws
9 propeller exhaust flange
10 center axial shaft mounting slot entrance
11 reinforced center axial shaft mounting area
12 base plate mounting holes
13 head of the center axial shaft
14 chosen mounting surface
15 square end of the center axial shaft mounting slot
16 stainless steel thrust washer
17 brass threaded insert
18 threaded end of the center axial shaft
19 square neck of the center axial shaft
20 flat surface of the head of the center axial shaft

SUMMARY

A marine spare propeller mount for use with propellers used on sterndrive units or large outboard motors. This invention having a base plate to secure the propeller by it's exhaust flange outside diameter and a center axial shaft which locks into the base plate in such a manner that it may be loaded after the base plate is mounted, to facilitate loading a propeller in the base plate with a sideways motion. By slipping the center axial shaft through the propeller hub after the thrust washer and the retaining knob have been started on the center axial shaft, in one smooth motion the center axial shaft and the propeller may be nested in there respective locking positions and the retaining knob may be tightened.

There is no significant size difference in the exhaust flange outside diameter of most propellers used on popular sterndrive units or on large outboard motors over 100 hp. This provides an ideal area for locating and mounting these propellers in the base plate.

PREFERRED EMBODIMENT—DESCRIPTION

Figure 2:
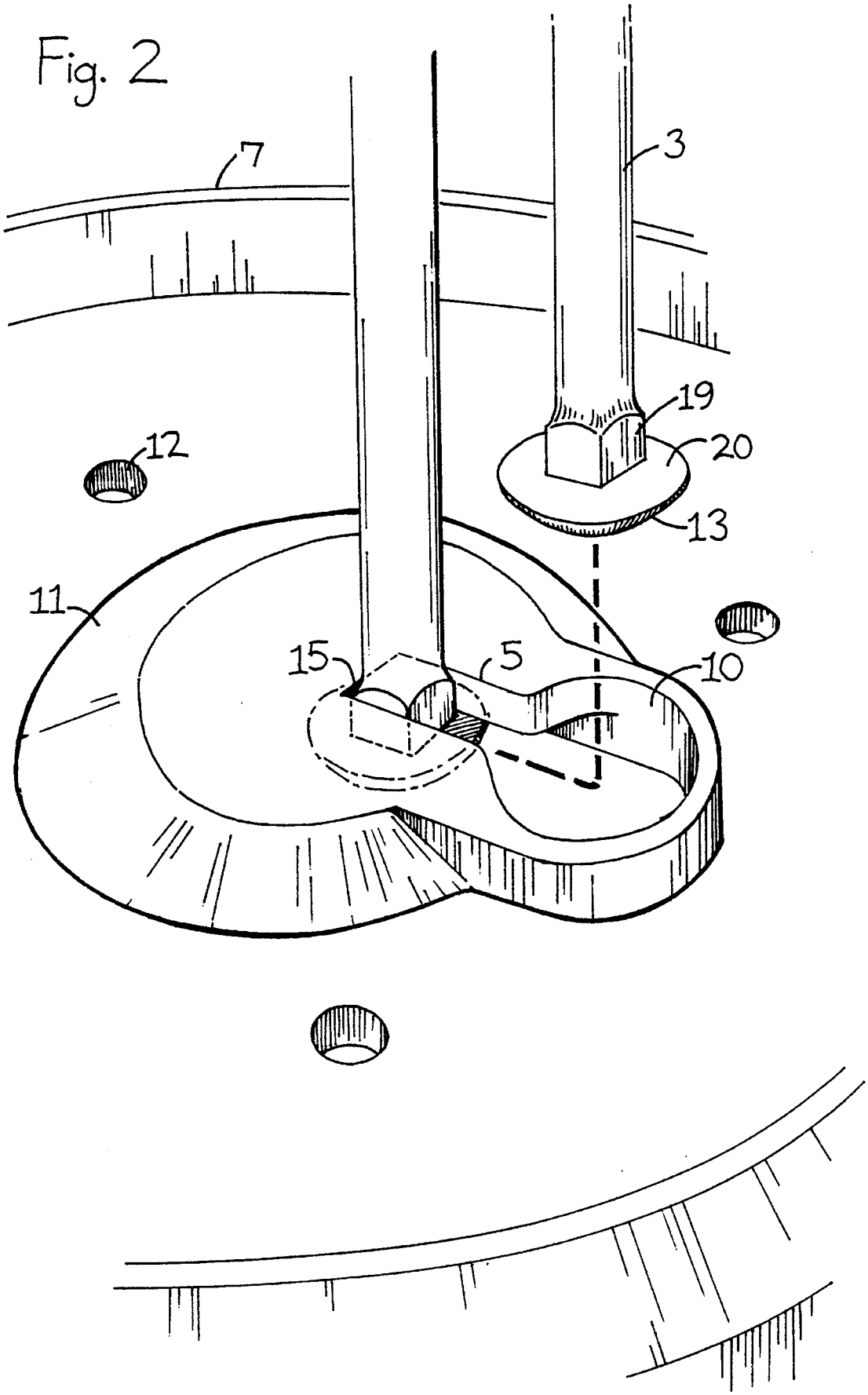
FIG. 2 shows the reinforced center axial shaft mounting area of the plastic base plate and its relationship to the center axial shaft and its sideways loadability.

FIG. 1 shows the plastic base plate 2 which has base plate raised retaining ring 7 and center axial shaft mounting slot 5 in reinforced center axial shaft mounting area 11. Plastic base plate 2 is mounted with stainless steel mounting screws 8 through base plate mounting holes 12 to the chosen mounting surface 14 in a marine vessel. A marine propeller 1 just above the plastic base plate 2 with the head of the center axial shaft 13 extended through the marine propeller 1 as well as a stainless steel thrust washer 16 and the retaining knob 4 with brass threaded insert 17 threaded identical to the threaded end of the center axial shaft 18 above the marine propeller 1. FIG. 2 shows the center axial shaft mounting slot 5 and the square neck of the center axial shaft 19 are of such dimension that the head of the center axial shaft 13 can be inserted through the center axial shaft mounting slot entrance 10 and slipped to the square end of the center axial shaft mounting slot 15 which prevents the stainless steel center axial shaft 3 from rotation while the flat surface of the head of the center axial shaft 20 prevents-the head of the center axial shaft 13 from pulling through the center axial shaft mounting slot 5.

FIG. 1 shows marine propeller 1 and the stainless steel center axial shaft 3 ready for assembly into center axial shaft mounting slot 5. The head of the center axial shaft 13 can be slipped into center axial shaft mounting slot 5 through center axial shaft mounting slot entrance 10 and slid to the square end of the center axial shaft mounting slot 15 and propeller exhaust flange 9 of marine propeller 1 can then be lowered into the plastic base plate 2 inside of the base plate raised retaining ring 7. Then the retaining knob 4 can be tightened against the stainless steel thrust washer 16 and propeller hub housing 6 and marine propeller 1 is retained.

Figure 3:
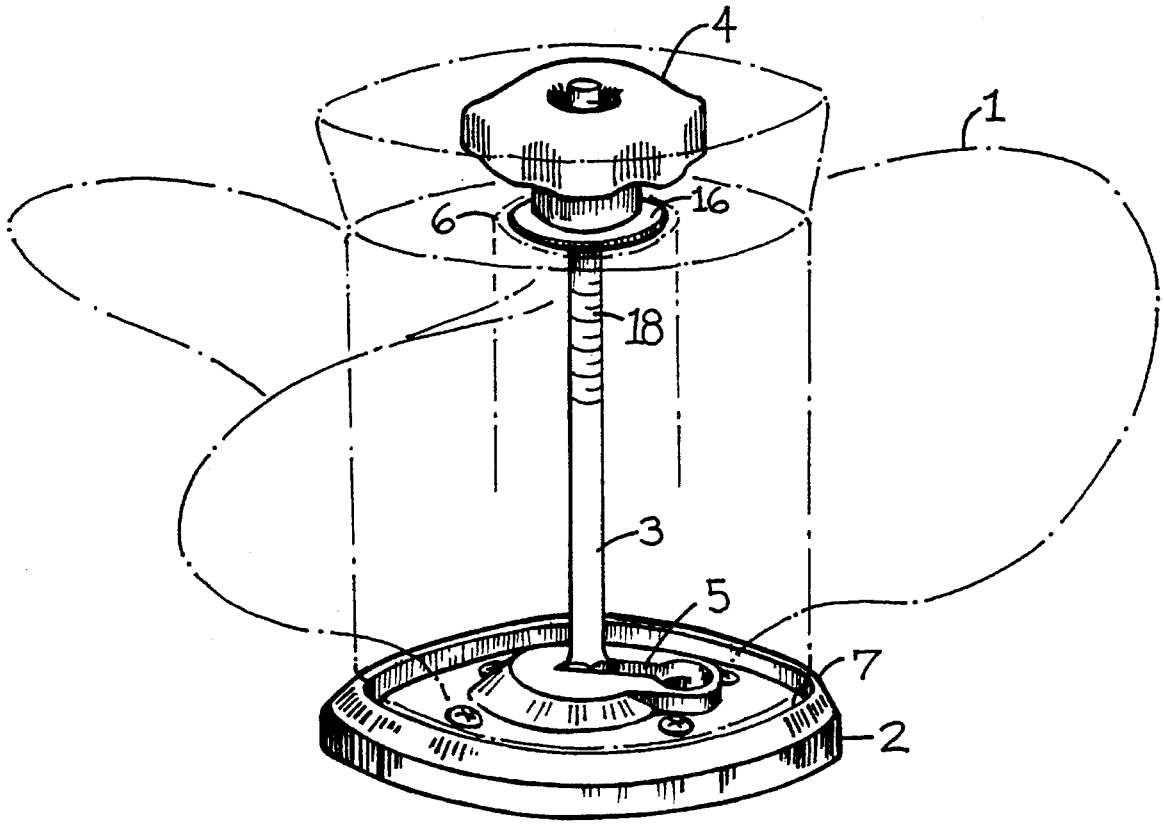
FIG. 3 shows a marine propeller mounted in accordance with the invention.

FIG.3 shows marine propeller 1 set into the base plate raised retaining ring 7 and retaining knob 4 screwed onto the threaded end of the center axial shaft 18 and tightened against the stainless steel thrust washer 16 seated on propeller hub housing 6.

PREFERRED EMBODIMENT—OPERATION

Operation of this invention is simple and straight forward. The stainless steel thrust washer 16 is slipped over the stainless steel center axial shaft 3 and the retaining knob 4 is started on the threaded end of the center axial shaft 18. Then this assembly is slid through the propeller hub housing 6 of marine propeller 1 leaving the head of the center axial shaft 13 exposed from the bottom of propeller hub housing 6 enough that it may be slipped into the center axial shaft mounting slot entrance 10 while holding propeller exhaust flange 9 just above the base plate raised retaining ring 7 of plastic base plate 2. Then as one assembly stainless steel center axial shaft 3 and marine propeller 1 can be slid into their final nesting positions and retaining knob 4 may be tightened against the stainless steel thrust washer 16 and the propeller hub housing 6 thus retaining marine propeller 1.

CONCLUSIONS, RAMIFICATIONS, AND SCOPE

Accordingly, it can be seen that this invention provides a safe and secure method to stow a spare propeller on board a recreational or work vessel powered by sterndrive units or large outboard motors.

Although the description above contains many specificities, these should not be construed as limiting the scope of the invention but as merely providing illustrations of some of the presently preferred embodiments of this invention. Various other embodiments and ramifications are possible within it's scope. For example, the plastic base plate 2 may be made from metal or plastic as well as the retaining knob 4 and stainless steel thrust washer 16, also different configurations of the square end of the center axial shaft mounting slot 15, the head of the center axial shaft 13 and the flat surface of the head of the center axial shaft 20 as well as the center axial shaft mounting slot 5 and the center axial shaft mounting slot entrance 10 can be used to achieve similar results without changing the intended scope of the invention.

Thus the scope of the invention should be determined by the appended claims and their legal equivalents, rather than by the examples given.

What is claimed is:

1. A sideways loadable marine propeller fixation device for fastening a marine propeller to a plastic base plate comprising; a center axial shaft, said center axial shaft having a first end and a second end, said center axial shaft having a threaded portion extending to said first end, said second end of said center axial shaft having a head, said head having a flat surface, said flat surface being perpendicular to the centerline of said center axial shaft and adjoining said head, said center axial shaft having a square neck adjoining said flat surface and opposite of said head, a retaining knob having a brass threaded insert so as to mate with said threaded portion of said center axial shaft, a plastic base plate having a plurality of screw clearance holes for fastening said plastic base plate to a mounting surface, said plastic base plate having a raised retaining ring circular in shape with an open inside diameter protruding on top of and perpendicular to said plastic base plate, said raised retaining ring having said open inside diameter dimensionally sized for locating and nesting a marine propeller by means of the marine propeller's exhaust flange outside diameter, said plastic base plate having a reinforced center axial shaft mounting area being an elevated area protruding from said plastic base plate adding increased thickness and strength to said plastic base plate and housing a center axial shaft mounting slot entrance and a center axial shaft mounting slot, said center axial shaft mounting slot entrance comprises an opening in said reinforced center axial shaft mounting area which is open through said plastic base plate to said mounting surface, said center axial shaft mounting slot entrance being open to and adjoining said center axial shaft mounting slot, said center axial shaft mounting slot having a square end, said square end of said center axial shaft mounting slot having two parallel sides formed by said center axial shaft mounting slot and a side opposite of said center axial shaft mounting slot entrance being perpendicular to said tow parallel sides, said square neck of said center axial shaft having any two opposing sides being dimensionally correct for sliding along said two parallel sides of said center axial shaft mounting slot, whereby said center axial shaft may be loaded into said center axial shaft mounting slot entrance in any axial rotated position about said centerline of said center axial shaft, said square neck of said center axial shaft may enter said center axial shaft mounting slot in any of four axial rotated positions about said centerline of said center axial shaft after said plastic base is mounted, whereby said head of said center axial shaft being in close proximity to the base plate and said mounting surface, and said flat surface of said center axial shaft traveling under said center axial shaft mounting slot, said square neck of said center axial shaft by means of contact with said square end of said center axial shaft mounting slot centering said center axial shaft in relation to said raised retaining ring and preventing said center axial shaft from rotation, said flat surface of said center axial shaft preventing said head of said center axial shaft from pulling through said center axial shaft mounting slot, a thrust washer to protect said retaining knob and the marine propeller from damage when tightening said retaining knob.

* * * * *